United States Patent [19]

Vogelsang

[11] 3,969,445

[45] July 13, 1976

[54] CARBURETOR HAVING A CHOKE DEVICE

[75] Inventor: Gustav Vogelsang, Braunschweig, Germany

[73] Assignee: Volkswagenwerk Aktiengesellschaft, Wolfsburg, Germany

[22] Filed: Dec. 3, 1974

[21] Appl. No.: 529,111

[30] Foreign Application Priority Data

Dec. 6, 1973 Germany ..... 2360859

[52] U.S. Cl. ..... 261/44 R; 261/DIG. 6; 261/DIG. 58

[51] Int. Cl.[2] ..... F02M 7/22

[58] Field of Search ..... 261/44 R, 50 A, DIG. 58, 261/DIG. 56, DIG. 6

[56] References Cited

UNITED STATES PATENTS

| | | | |
|---|---|---|---|
| 796,723 | 8/1905 | Hewitt | 261/DIG. 6 |
| 2,073,649 | 3/1937 | Price | 261/44 R |
| 2,118,220 | 5/1938 | Mock | 261/44 R |
| 2,229,313 | 1/1941 | Snyder | 261/50 A |
| 2,598,450 | 5/1952 | Shaff | 261/50 A |
| 3,263,974 | 8/1966 | Braun et al. | 261/50 A |
| 3,322,408 | 5/1967 | Stoltman | 261/50 A |
| 3,334,876 | 8/1967 | Shorrock | 261/DIG. 58 |
| 3,342,462 | 9/1967 | Mick | 261/23 A |
| 3,342,464 | 9/1967 | Mick | 261/50 A |
| 3,392,965 | 7/1968 | Harrison | 261/50 A |

*Primary Examiner*—Tim R. Miles
*Attorney, Agent, or Firm*—Spencer & Kaye

[57] ABSTRACT

A carburetor has a choke device formed of two planar quadrangular choke flaps situated side-by-side in a cross-sectionally quadrangular flow passage of an engine intake manifold. The pivotal supports for the choke flaps are held in recesses of the manifold wall and define a pivotal axis that lies in an edge zone of the choke flaps that is immediately adjacent the manifold wall. The choke flaps further have cooperating edge zones that together define the cross section of the flow passage as a function of pressure conditions in the intake manifold. In the fully open position, the choke flaps are in a face-to-face engagement with opposite wall portions of the intake manifold.

11 Claims, 3 Drawing Figures

CARBURETOR HAVING A CHOKE DEVICE

BACKGROUND OF THE INVENTION

This invention relates to a carburetor for internal combustion engines and is of the type which includes a fuel metering device having a fuel outlet opening situated in the axis of the intake manifold upstream of an arbitrarily operated butterfly throttle valve. The carburetor further has a choke device which is situated upstream of the fuel outlet opening and which serves for the pressure-dependent setting of the air flow passage section of the intake manifold. The choke device includes two components that are generally quadrangular in shape and that are disposed in the flow passage of the intake manifold. Each component is pivotal about an axis that extends generally along an edge of the component. These edges of the one and the other component are parallel to and remote from one another. The components execute pivotal movements simultaneously in mutually opposite directions as a function of the prevailing pressure conditions in the intake manifold and define together — by means of parts oriented towards one another — the flow passage section for the intake air. The carburetor according to the invention finds application particularly, but not exclusively, in internal combustion engines associated with motor vehicles.

A carburetor of the above-outlined type as disclosed, for example, in German Laid-Open Application (Offenlegungsschrift) No. 2,201,253 has, in very general terms, the advantage that it ensures a better mixture preparation in all load ranges of the internal combustion engine. In the known carburetor, the device for the pressure-dependent setting of the air flow passage section includes two components which are pivotally supported in the intake manifold and which have such a configuration that during opposed simultaneous pivotal motions, they roll on each other in the central zone of the inner cross-sectional area of the intake manifold and together define a circular flow passage section of variable magnitude. This arrangement has the advantage that for any setting of the device the maximum flow velocity of the air passing through the flow passage section is located in the zone of the fuel outlet of the fuel metering device. It is, however, a disadvantage of the above-outlined known structure that between the outer edges of the two components, on the one hand, and the wall of the intake manifold, on the other hand, there appear relatively wide clearances through which — particularly in case the device is substantially closed — there is generated a significant secondary flow situated externally of the zone of the fuel outlet. It is apparent that the air in such secondary flow does not appreciably contact the fuel emitted through the outlet opening of the fuel metering device. Further, the known device has, due to the design of the components as three-dimensional members and due to the arrangement of their pivotal axis in the flow path of the intake air, a disadvantageously large flow resistance.

SUMMARY OF THE INVENTION

It is an object of the invention to provide an improved carburetor of the above-outlined type, from which the discussed disadvantages are eliminated under the preservation of advantageous properties.

This object and others to become apparent as the specification progresses, are accomplished by the invention, according to which, briefly stated, the carburetor has a choke device formed of two planar quadrangular choke flaps situated side-by-side in a cross-sectionally quadrangular flow passage of an engine intake manifold. The pivotal supports for the choke flaps are held in recesses of the manifold wall and define a pivotal axis that lies in an edge zone of the choke flaps that is immediately adjacent the manifold wall. The choke flaps further have cooperating edge zones that together define the cross section of the flow passage as a function of pressure conditions in the intake manifold. In the fully open position, the choke flaps are in a face-to-face engagement with opposite wall portions of the intake manifold.

Since, according to the invention, the components are designed as planar choke flaps which thus, in an open position, together define a slot of variable width constituting the air flow passage section, the possibility is provided to design the inner wall of the intake manifold in such a manner that the axes of the choke flaps are recessed and the choke flaps lie flat against the wall in their fully open position. Since further, the flow passage of the intake manifold in the zone of the choke flaps has a quadrangular inner cross section, the manifold wall snugly surrounds the quadrangular cross-sectional outline of the choke device according to the invention, so that clearances giving rise to disturbing secondary flows do not appear.

Downstream of the flow passage section defined by the choke flaps, there is situated the outlet opening of the fuel metering device. The fact that the flow passage section has a slot-like configuration which means that it extends in part laterally beyond the fuel outlet opening is practically without significance once the inner cross section of the intake manifold is rectangular and the axes of the two choke flaps extend transversely to the long sides of the rectangle. In such a case the slot which forms the air flow passage section and which is situated between the two choke flaps extends only slightly laterally of the zone of the fuel outlet opening of the fuel metering device.

Downstream of the choke flaps the inner cross section of the intake manifold changes from a rectangular shape to a circular configuration, to accommodate the conventional, circular throttle valve (butterfly valve) connected to the accelerator pedal. A conventional fuel supply means for the idling run may be arranged in the zone of the throttle valve.

The actuation of the choke device designed according to the invention, that is, the pivoting of the two choke flaps, is effected by the pressure conditions in the intake manifold in a spring-assisted manner. It is therefore expedient to maintain the moving masses as small as possible. The invention also seeks to eliminate additional projecting parts of the device which increase the flow resistance. Thus, to avoid damage to the device in case of carburetor backlash, according to a preferred embodiment of the invention it is provided that, instead of using a check valve of conventional structure, one of the choke flaps in the closed position overlaps an upstream disposed edge zone of the other choke flap and it is only the latter choke flap which is pivotable in a direction opposite the direction of flow and against the force of a spring during carburetor backlashes.

The elimination or at least reduction of those operating mechanisms (for example for actuating the fuel metering device) that extend into or are disposed entirely within the inner cross-sectional outline of the intake manifold also serves the purpose of achieving an as low flow resistance as possible. The fuel metering device generally includes, as known, a metering needle having a conical terminus which is displaceably held in a small tube, whereby the magnitude of the annular flow passage section of the small tube is dependent upon the axial position of the metering needle. If a fuel metering device of this type is used, operating levers and the like disposed within the flow passage of the intake manifold may be omitted if with the metering needle there is associated, externally of the flow passage of the manifold, a resetting spring and with one of the choke flaps there is connected a lever which is disposed externally of the flow passage and which effects the opening motions of the metering needle in synchronism with the movements of the choke flaps. Thus, when the choke flaps execute their opening movement, the latter synchronously displace the metering needle in the sense of a wider opening of the outlet cross section for the fuel. On the other hand, the motion of the metering needle in the sense of a reduction of the outlet opening of the fuel metering device is effected solely by the resetting spring. This provides the possibility to design a lever mechanism which is connected to the metering needle externally of the flow passage of the intake manifold and which may effect an enrichment of the air-fuel mixture independently from the operation of the choke flaps, for example during cold-engine start and during vehicle start.

Contrary to the above-outlined known structures, the invention thus dispenses with the provision of needle-actuating levers or link rods within the flow passage of the intake manifold. If the choke flaps, on the other hand, are not designed in such a manner that they assume their closed position in a predetermined sequence, it is expedient to interconnect them by a linkage system to effect synchronous choke flap motions. Such a coupling may be effected by so arranging the choke flaps that in their closed position they form an angle pointing downstream (that is, in the direction of air flow). The linkage system is formed of a three-lever assembly. Two of the levers are, with one of their ends, connected in the closing direction rigidly with the one and the other choke flap under different angles, while the free ends of the two levers are coupled by means of articulated joints with the one and the other end of the third lever. Since this lever system requires only very limited space, it practically has no effect on the flow resistance.

DESCRIPTION OF THE PREFERRED EMBODIMENT

Figure 1:
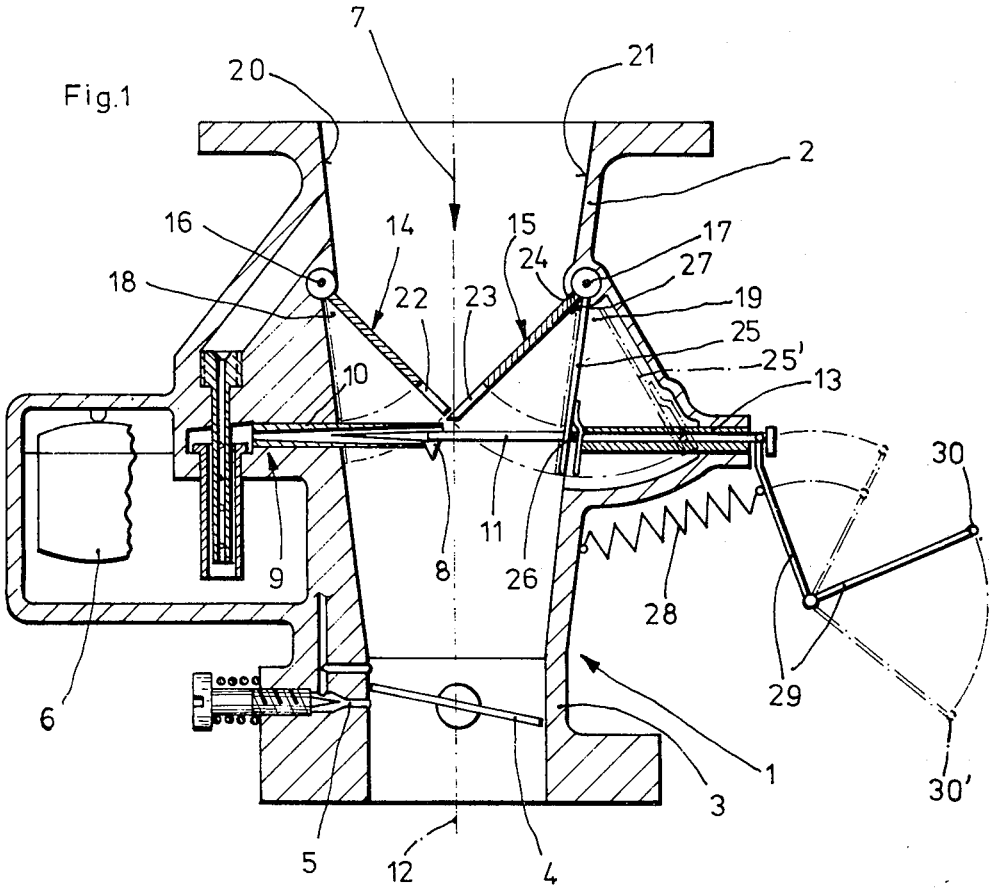
FIG. 1 is a schematic sectional view of a preferred embodiment of the invention taken along the axis of the intake manifold.

Turning now to FIG. 1, there is illustrated a portion of an intake manifold generally indicated at 1. It is noted that this manifold portion may also be constituted — as it may be well observed in FIG. 1 — by a carburetor housing. The manifold portion 1 has an upper zone 2 which is tapering in the downstream direction (with respect to the direction of air flow as indicated by the arrow 7) and which has a flow passage of quadrangular cross-sectional area. The manifold portion 1 further has a lower zone 3 which adjoins downstream the upper zone 2 and which has a flow passage of circular cross section. In the zone 3 there is situated a conventional butterfly throttle valve 4 connected with an accelerator pedal (not shown). In the zone of the butterfly valve 4 a fuel supply port 5 for engine idling merges into the flow passage of the intake manifold. The port 5 communicates with a float housing 6 of the carburetor in a conventional manner.

Upstream of the butterfly valve 4 there is situated the outlet opening 8 of a fuel metering device which is generally indicated at 9 and which has a conventional structure. The fuel metering device 9 is supplied with fuel from the float housing 6. Relevant components of the fuel metering device 9 are a nozzle tube 10 and a metering needle 11 extending into the nozzle tube 10 with a tapered end portion terminating in a needle point. The metering needle 11 and the inner wall of the nozzle tube 10 defining the outlet opening 8, together determine the annular cross-sectional area of the fuel outlet passage. The magnitude of this cross-sectional area depends from the axial position of the metering needle 11 with respect to the nozzle tube 10. Significantly, this cross-sectional area is situated in the zone of the axis 12 of the entire carburetor system. The metering needle 11 is guided for horizontal displacement in the nozzle tube 10 and a guide tube 13 which is disposed in axial alignment with the nozzle tube 1 externally of the intake manifold 1.

Upstream of the nozzle tube 10 of the fuel metering device 9 there are situated two choke flaps 14 and 15 which form part of a device for the pressure-dependent setting of the flow passage section in the upper zone 2 of the intake manifold 1. The choke flaps 14 and 15 are disposed side-by-side in the flow passage, transversely to the axis 12. The choke flaps 14 and 15 are both planar and are, in mutually remote edge zones, pivotally supported on shafts 16 and 17, respectively. The shafts 16 and 17, in turn are held in respective recesses 18 and 19 provided in opposite locations in the inner wall of the intake manifold 1. In this manner it is ensured that the support mechanism for the choke flaps 14 and 15 does not constitute an appreciable flow resistance for the intake air. Further, the recesses 18 and 19 are designed in such a manner that the choke flaps 14 and 15 form, in their fully open position, a continuation of the upper inner walls 20 and 21 respectively, of the intake manifold 1. Stated differently, in their fully open position, the choke flaps 14 and 15 are in a face-to-face engagement with planar inner wall portions of the zone 2 of the intake manifold 1.

In FIG. 1 the choke flaps 14 and 15 are shown in solid lines in the idling (closed) position in which the width of the usually present slot constituting the air flow passage section has been reduced to zero. A certain flow is, nevertheless, generated in the zone of the fuel outlet opening 8, since the choke flaps 14 and 15 are provided with cutouts or slots 22 and 23 disposed in the zone of the axis 12 when the choke flaps 14 and 15 assume their position shown in solid lines in FIG. 1. By means of this arrangement the flow of intake air is, in a desired manner, concentrated in the zone of the fuel outlet opening 8.

While the choke flap 14 is articulated by means of its associated shaft 16 in such a manner that it is capable of being pivoted against the direction of flow (that is, counterclockwise) beyond its shown closed position in case of carburetor backlashes and thus constitutes a check valve, the choke flap 15, in its closed position, abuts a stop 24 so that it cannot participate with the choke flap 14 in such motions. The above-described backward swing of the choke flap 14 is made possible by so arranging the two choke flaps with respect to one another that the edge portion of the choke flap 15, which is oriented towards the axis 12, overlaps and is supported by the edge portion of the other choke flap 14.

Figure 1A:
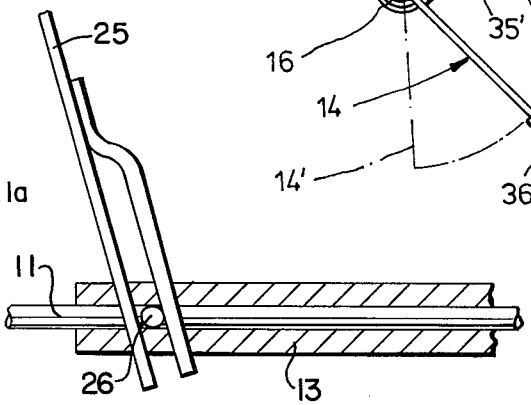
FIG. 1*a* is an enlarged detail of FIG. 1.

As it may be observed from FIG. 1, within the inner cross-sectional area (flow passage) of the intake manifold 1, there are provided no levers or other components for operating the fuel metering device 9 or, more particularly, for causing the transversal horizontal motions of the metering needle 11. The nozzle tube 10 and the metering needle 11 are situated in such a proximity of the choke flaps 14 and 15 that they project into the travelling path of the choke flaps 14 and 15. For this reason, the slots 22 and 23 provided in the respective choke flaps 14 and 15 are designed in such a manner that the nozzle tube 10 or the metering needle 11, respectively, are aligned with, and thus extend into the slots 22, 23 during the pivotal motions of the choke flaps so as not to interfere therewith. This arrangement further contributes to the formation of the air flow in the zone of the fuel outlet opening 8 in each position of the choke flaps. For effecting an axial displacement of the metering needle 11, there is provided a lever 25 which, with its lower, fork-shaped terminus, straddles a pin 26 affixed to the metering needle 11. The lever 25 is, at its upper terminus, articulated to the shaft 17 and is thus movable with respect to the choke flap 15. During the opening movements of the choke flap 15, the latter urges the lever 25 — by means of an abutment 27 secured, for example, to the choke flap 15 — in a counterclockwise direction into a position 25' shown in broken lines. The coupling between the lever 25 and the metering needle 11 can be particularly well observed in FIG. 1*a* in which the components 11, 25 and 26 are shown displaced towards the right relative to their position illustrated in solid lines in FIG. 1. During its counterclockwise swing, the lever 25 draws the metering needle 11 towards the right, whereby the flow passage section 8 of the nozzle tube 10 is increased, resulting in increased fuel flow. On the other hand, the motion of the fuel metering needle 11 towards the left, that is, towards a decrease of the outlet opening 8, is effected by a return spring 28 which cooperates with a bell crank lever 29. The free terminus of one arm of the bell crank lever 29 is coupled to that terminus of the fuel metering needle 11 which is remote from the nozzle tube 10. The fact that by virtue of the above described arrangement, a motion of the metering needle 11 towards an increased fuel outlet opening 8 is not preconditioned by an opening motion of the choke flap 15, but if such an opening motion of the choke flap 15 does take place, a further increase of the fuel outlet opening 8 necessarily follows, provides the advantageous possibility to move — for example manually or by means of a temperature-responsive automatic device operative for cold-engine starts — the metering needle 11 towards the right effecting an increase in the area of the outlet opening 8. For this purpose to the bell crank lever there is attached an actuating member (such as a cable) at 30 which is adapted to move the bell crank lever 29 clockwise, whereby point 30 will assume a position 30'.

It is expedient to provide the lever 25 with a relatively weak torque-exerting spring (not shown) which urges the lever 25 against the abutment 27.

Figure 2:
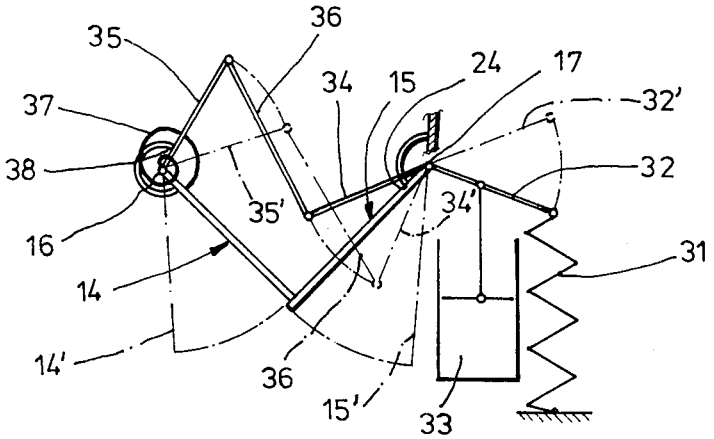
FIG. 2 is a schematic illustration of a lever assembly for connecting two components illustrated in FIG. 1.

Turning now to FIG. 2, the choke flaps 14 and 15 are shown in their respective closed position in solid lines. For resetting both choke flaps 14 and 15 there is provided a tension spring 31 which is connected to a lever 32 affixed to the choke flap 15. To the lever 32 there is also connected a dashpot device 33 which serves for damping oscillations.

To insure that synchronous closing and opening movements of the two choke flaps take place, yet allow a movement of the choke flap 14 beyond its closed position in an upstream direction (in response to backlash pressures) a three-lever linkage system is provided which will now be described.

The three-lever linkage system comprises a first lever 34 which, at one of its ends, is rigidly connected to the choke flap 15. It is seen that in the closed position of the choke flaps 14 and 15, the first lever 34 is so oriented that it extends from the choke flap 15 in a direction having a downstream-pointing component.

The three-lever linkage system has a second lever 35 which, at its one end, is jointedly connected to the choke flap 14. An abutment 38 ensures that the variable angle between the choke flap 14 and the lever 35 has a predetermined maximum value. A spring 37 urges the choke flap 14 and the lever 35 pivotally apart for assuming the maximum predetermined angle. It is seen that in the closed position of the choke flaps 14 and 15, the second lever 35 is so oriented that it extends from the choke flap 14 in a direction having an upstream pointing component.

The three-lever linkage system has a third lever 36 which, at its two ends, is jointedly connected to those ends of the lever 35 and 34 which are remote from the choke flaps 14 and 15, respectively.

In case of downstream-directed, air pressure-derived forces exerted on the choke flaps 14, 15 overcoming the force of the spring 31, the choke flaps will move in an opening direction. The fully open position is shown in phantom lines in FIG. 2.

If, on the other hand, the downstream-directed forces on the choke flaps 14, 15 are smaller than the force of the spring 31, the latter will move the choke flaps 14 and 15 synchronously towards their closed position. While the closing motion of the choke flap 15 is effected by the lever 32 directly, the closing motion of the choke flap 14 is caused indirectly by means of the linkage system 34, 35, 36.

Should, in the closed position of the choke flaps 14, 15, an upstream-directed carburetor backlash occur, the choke flap 14 will, against the force of the spring 37, execute, from its closed position, an upstream swing in response to the backlash, thus reducing the maximum predetermined angle between the choke flap 14 and the second lever 35.

The arrangement of the choke flaps 14 and 15 in such a manner that in a closed position they form a downstream-pointing angle is advantageous as opposed to a planar (180°) arrangement, since even relatively small pivotal opening motions give rise to an air flow regulating slot. In a coplanar (180°) arrangement of the choke flaps in the closed position, in contradistinction, there is needed an initial, relatively large angular motion of the adjoining flap edges that define the slot for the air flow passage. It is noted, as it may be observed in FIG. 2, that the angular positioning of the choke flaps 14 and 15 in their closed position is utilized to accommodate part of the linkage system 34, 35, 36.

It is to be understood that the linkage system, together with the associated abutments may be arranged entirely externally of the intake manifold. By virtue of its small volume and the thus inherent small flow resistances, however, it is a very advantageous possibility, particularly in view of the small spatial requirement, to provide the linkage system within the intake manifold as described in connection with FIG. 2.

It will be understood that the above description of the present invention is susceptible to various modifications, changes and adaptations, and the same are intended to be comprehended within the meaning and range of equivalents of the appended claims.

I claim:

1. In a carburetor serving an internal combustion engine and including a fuel metering device which has means defining a fuel outlet opening disposed in the zone of the longitudinal axis of the flow passage of an intake manifold having walls defining the flow passage; an arbitrarily actuatable throttle flap situated in the flow passage downstream of the fuel outlet opening; a choke means situated in the flow passage upstream of the fuel outlet opening for the pressure-dependent setting of the cross-sectional area of the flow passage, the improvement comprising a. two planar, quadrangular choke flaps situated generally side-by-side in said flow passage transversely to the manifold axis; said choke flaps forming part of said choke means and each having
   1. a first edge zone extending along the manifold wall in close vicinity thereof; the first edge zones of the one and the other said choke flap being remote with respect to one another;
   2. a second edge zone extending generally parallel to said first edge zone; the second edge zones of the one and the other choke flap being adjacent one another and together defining a cross-sectional area of said flow passage;

b. means defining recesses in the manifold wall at opposite locations transversely to the manifold axis;

c. pivotal support means held in said recesses and connected to each said choke flap for providing pivotal motion of each choke flap about a pivotal axis extending in and along said first edge zone of each choke flap; the pivotal axes of the one and the other choke flap being parallel to one another;

d. a manifold wall portion defining a quadrangular cross section of the flow passage of said intake manifold in the zone of said choke flaps, said wall portion closely surrounding said choke flaps in any pivotal position thereof;

e. means for effecting a face-to-face engagment of each choke flap with said wall portion in a fully open position of said choke flaps;

f. spring means connected to one of said choke flaps for urging the latter in the direction of said fully open position; and g. means for so arranging said choke flaps with respect to one another that in a closed position of said choke flaps the other of said choke flaps overlaps, with its said second edge zone, the second edge zone of said one choke flap for allowing pivotal motion of said one choke flap against the force of said spring means beyond said closed position in response to backlash pressures in said flow passage.

2. A carburetor as defined in claim 1, wherein said quadrangular cross section has the shape of a rectangle, said pivotal axes being oriented perpendicularly to the long sides of the rectangle.

3. A carburetor as defined in claim 1, further comprising a manifold wall portion defining a circular cross section of the flow passage of said intake manifold in the zone of said throttle flap.

4. A carburetor as defined in claim 1, further comprising means defining cutouts in said second edge zone of each choke flap; said fuel metering device including a metering needle passing through said fuel outlet opening and extending within said flow passage transversely to the axis thereof, said metering needle intersecting the travelling path of said choke flaps and being in alignment with said cutouts.

5. A carburetor as defined in claim 4, further comprising a spring means connected to said metering needle for urging it towards a closed position; and a lever affixed to one of said choke flaps and coupled to said metering needle for effecting a synchronous opening movement of said choke means and said metering needle; said spring means and said lever being disposed externally of said flow passage.

6. In a carburetor serving an internal combustion engine and including a fuel metering device which has means defining a fuel outlet opening disposed in the zone of the longitudinal axis of the flow passage of an intake manifold having walls defining the flow passage; an arbitrarily actuatable throttle flap situated in the flow passage downstream of the fuel outlet opening; a choke means situated in the flow passage upstream of the fuel outlet opening for the pressure-dependent setting of the cross-sectional area of the flow passage, the improvement comprising a. a first and a second planar, quadrangular choke flap situated generally side-by-side in said flow passage transversely to the manifold axis; said choke flaps forming part of said choke means and each having
   1. a first edge zone extending along the manifold wall in close vicinity thereof; the first edge zones of the first and the second choke flap being remote with respect to one another;
   2. a second edge zone extending generally parallel to said first edge zone; the second edge zones of the first and the second choke flap being adjacent one another and together defining a cross-sectional area of said flow passage;

b. means defining recesses in the manifold wall at opposite locations transversely to the manifold axis;

c. pivotal support means held in said recesses and connected to each said choke flap for providing pivotal motion of each choke flap about a pivotal axis extending in and along said first edge zone of each choke flap; the pivotal axes of the first and the second choke flap being parallel to one another;

d. a manifold wall portion defining a quadrangular cross section of the flow passage of said intake manifold in the zone of said choke flaps, said wall portion closely surrounding said choke flaps in any pivotal position thereof;

e. means for effecting a face-to-face engagement of each choke flap with said wall portion in a fully open position of said choke flaps;

f. a first lever having first and second ends; said first end of said first lever being rigidly connected to said first choke flap;

g. a second lever having first and second ends;

h. means for jointedly connecting said first end of said second lever to said second choke flap;

i. abutment means positioned between said first end of said second lever and said second choke flap for determining a maximum angl between said second choke flap and said second lever;

j. a first spring connected to said second choke flap for urging the same away from said second lever towards said maxmum angle;

k. a third lver having two ends being jointedly connected to the respective second ends of said first and second levers;

a second spring connected to said first choke flap for directly urging the latter towards said closed position and for indirectly urging said second choke flap into said closed position by said first, second and third levers; and m. means for so arranging said choke flaps with respect to one another that in a closed position of said choke flaps said first choke flap overlaps, with its said second edge zone, the second edge zone of said second choke flap for allowing pivotal motion of said second choke flap relative to said second lever against the force of said first spring beyond said closed position in response to backlash pressures in said flow passage.

7. A carburetor as defined in claim 6, said choke flaps, when in their closed position, meet in a downstream-pointing angle.

8. A carburetor as defined in claim 7, said first, second and third levers being disposed in said flow passage upstream of said choke flaps in the closed position thereof.

9. A carburetor as defined in claim 8, wherein at least a portion of a linkage system constituted by said first, second and third levers is situated in a space bounded by said choke flaps in their closed position.

10. A carburetor as defined in claim 7, wherein during normal operation of said choke means the angle defined between said first lever and said first choke flap is different in magnitude from the angle defined between said second lever and said second choke flap.

11. A carburetor as defined in claim 7, wherein in the closed position of said choke flaps said first lever extends from said first choke flap in a first direction and said second lever extends from said second choke flap in a second direction; one of said first and second directions having a directional component pointing upstream, the other of said first and second directions having a directional component pointing downstream.

* * * * *